United States Patent [19]

Abelitis et al.

[11] 4,119,396

[45] Oct. 10, 1978

[54] METHOD AND APPARATUS FOR THE THERMAL TREATMENT OF MOIST, GRANULAR MATERIALS

[75] Inventors: Andris Abelitis; Artur Behrendt, both of Hoffnungsthal; Jakob Hinterkeuser, Menden, all of Germany

[73] Assignee: Köckner-Humboldt-Deutz Aktiengesellschaft, Germany

[21] Appl. No.: 764,446

[22] Filed: Jan. 31, 1977

[30] Foreign Application Priority Data

Feb. 10, 1976 [DE] Fed. Rep. of Germany ..... 2605042

[51] Int. Cl.[2] ..... F27B 15/00

[52] U.S. Cl. ..... 432/106; 432/14; 106/100; 34/57 R

[58] Field of Search ..... 432/14, 16, 58, 106; 106/100; 34/57 R, 57 E

[56] References Cited

U.S. PATENT DOCUMENTS

| | | | |
|---|---|---|---|
| 3,309,785 | 3/1967 | King | 34/57 R |
| 3,843,314 | 10/1974 | Ishikawa | 432/58 |
| 3,865,602 | 2/1975 | Stich et al. | 432/16 |
| 3,904,353 | 9/1975 | Bosshard et al. | 432/106 |
| 3,975,148 | 8/1976 | Fukuda et al. | 432/106 |
| 4,010,551 | 3/1977 | Rohde | 432/58 |
| 4,039,277 | 8/1977 | Kobayashi et al. | 432/106 |

*Primary Examiner*—Henry C. Yuen

*Attorney, Agent, or Firm*—Hill, Gross, Simpson, Van Santen, Steadman, Chiara & Simpson

[57] ABSTRACT

Method and apparatus for the thermal treatment of moist, granular materials utilizing at least two superposed cyclone separators, with a relatively long gas conduit connecting the lower cyclone separator to the upper one. Charging means are provided in the conduit for introducing material to be treated near the lower cyclone separator, and a venturi-type constriction is provided in the conduit below the charging means, the constriction having its lower end projecting into the lower cyclone separator and serving to break up lumps of material which might otherwise be deposited in the cyclone separator and transfer the particulate material to the upper cyclone separator.

3 Claims, 2 Drawing Figures

METHOD AND APPARATUS FOR THE THERMAL TREATMENT OF MOIST, GRANULAR MATERIALS

BACKGROUND OF THE INVENTION

1. Field of the Invention

This invention is in the field of heat exchangers for the thermal treatment of finely divided, moist materials which involve providing at least two cyclone separators and employing a venturi-type constriction in the feeding means to the lower of the two cyclone separators to improve the thermal efficiency of the unit.

2. Description of the Prior Art

Heat exchangers for the thermal treatment of finely divided materials usually include a rotary kiln to which there is connected a series of cyclone separators. In such thermal treatment, the material charged frequently includes lumps which are so heavy that they are not taken along with the hot gases flowing upwardly in the system but instead drop downwardly against the gas flow and ultimately settle into a cyclone separator. When this happens, not only does the cyclone separator have undesired formations of inclusions and clogging of the discharge area, but the insufficiently thermally heat treated raw materials may contaminate the resulting end product.

SUMMARY OF THE INVENTION

The present invention provides a special arrangement and construction of a gas conduit into which the raw material is charged to prevent lumpy pieces of material falling through against the gas flow into the cyclone separator located below the conduit. To accomplish this, the gas conduit below the charging point of the raw material is provided with a venturi-type cross-sectional constriction which has a lower end projecting into the cyclone separator. With this venturi-type cross-sectional constriction below the charging point for the raw material, a very high velocity of gas flow is produced in this area so that the coarser particles of material or lumps arriving with the moist raw materials into the gas conduit are either taken up or broken up by the gas flow, or held in suspension in this area so long that they break up and may be discharged upwardly with the gases issuing through the conduit into the upper cyclone separator. The settling of the moist, lumpy materials into the cyclone separator located below the charging point for raw material and the disadvantages which accrue therefrom are therefore prevented. Furthermore, since the end of the conduit projects as an immersion tube into the cyclone separator, the torsional forces of the gas flow in the cyclone separator are used to advantage for the discharge of the fine grained particles from the area sheltered from the prevailing currents. This leads to an improvement in the sifting effect in the conical venturi shaped part and accordingly results in an improvement in the heat exchange and material exchange between the hot gases and the finely divided granular materials.

In a preferred embodiment of the present invention, the venturi-type cross-sectional constriction is provided in the area of the exhaust gas conduit extending within the cyclone separator.

By means of a nozzle-shaped or conical inlet end provided in the immersion pipe, the flow resistance of the so-called Borda aperture is lowered. Furthermore, a heating on all sides of the venturi-type cross-sectional constriction is achieved through the hot gases, which favors the heat transfer to the material in the venturi-shaped section. Further, through the torsion energy of the cyclone flow in the venturi-type immersion pipe, an increase in the heat exchange from the gas to the material is accomplished.

A further improvement in the present invention consists in equipping the lower area of the cyclone separator with at least one burner. This burner provides an intensive, shock-type temperature effect to the material before it is discharged from the eddy area of the venturi-type pipe constriction, thereby disintegrating or comminuting the coarse grains present in the material being treated.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
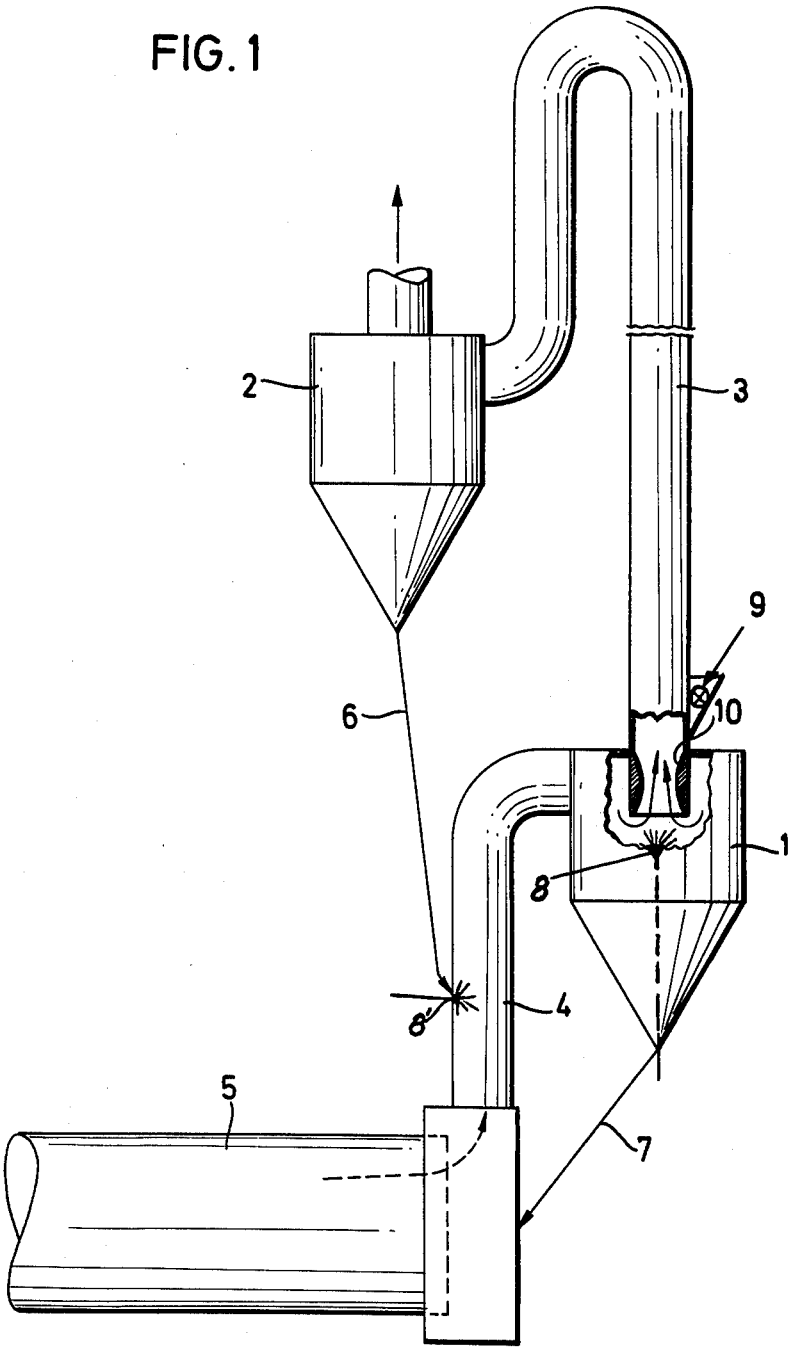
FIG. 1 is a somewhat diagrammatic showing of a heat exchanger with two cyclone separators attached to the exhaust gas side of a rotary kiln, and embodying the principals of the present invention.

As shown in FIG. 1, the heat exchanger system consists of two cyclone separators 1 and 2 arranged in superposed relation, and interconnected by means of a relatively long gas conduit 3. The lower cyclone separator 1 is attached to an exhaust gas conduit 4 of a rotary kiln 5. A material discharge conduit 6 of the upper cyclone separator 2 is directed into the exhaust pipe 4. A material discharge conduit 7 of the cyclone separator 1 is used in conjunction with an auxiliary burner 8. This burner 8 may be fixedly secured in the lower cyclone separator 1 or it may be adjustable as to height.

To supply the finely divided moist raw materials into the two-step heat exchanger, there is provided above the cyclone separator 1 a charging apparatus 9 having a discharge end opening into the exhaust gas conduit 3. The lower end of the conduit 3 projects in the manner of an immersion pipe into the cyclone separator 1 from above, and has in its area immediately adjacent to the entrance point to the cyclone separator, a venturi-type cross-sectional constriction 10.

In the operation of this apparatus, the finely divided moist materials are introduced into the gas conduit 3 by means of the charging apparatus 9. In the conduit, they are taken along with the hot gases flowing upwardly in the conduit and separated in the upper cyclone separator 2. In this way, the finely granular, moist materials come in contact with the hot gases intensively and relatively long, whereby a drying of the raw materials takes place to such an extent that they may occur in the cyclone separator 2 as a dry product. This pre-treated or pre-dried material passes through the cyclone separator 2 into the material discharge conduit 6 and thence into the exhaust gas pipe 4 in which it is suspended by the hot exhaust gases and discharged in suspension upwardly into the cyclone separator 1. It may be advisable in some cases to provide an additional burner 8' in the exhaust gas pipe 4 in the area of the opening of the discharge conduit 6 in order to intensify the thermal post-treatment of the material. The hot furnace gases flowing upwardly and issuing from the rotary kiln 5 through the exhaust gas conduit 4, cyclone separator 1, gas conduit 3, and upper cyclone separator 2 are drawn off upwardly with the aid of a suction blower (not shown) and, after removal of dust, may be conveyed outwardly in an electric filter.

The presence of the venturi-type cross-sectional constriction 10 in the lower area of the gas conduit 3 significantly increases the speed of gas flow so that coarser lumpy portions of material in the charge material are taken along in suspension by the gases flowing upwardly through the gas conduit 3 into the upper cyclone separator 2 during which time the coarser portions may be broken up because of the temperature effect. In the event that lumpy portions present in the charging material should drop through the venturi-type cross-sectional constriction 10 in the lower cyclone separator 1, they are met with a sudden impact of heat from the burner 8 in the cyclone separator and are broken up. In addition, since the end of the gas conduit 3 extends from above into the cyclone separator 1, the torsion energy of the gas is employed and thereby the thermal heat treatment of the moist materials is improved. The material pre-treated thermally in this manner arrives through the material conduit 7 in the rotary kiln 5 in which post-treatment or finishing treatment may take place.

Figure 2:
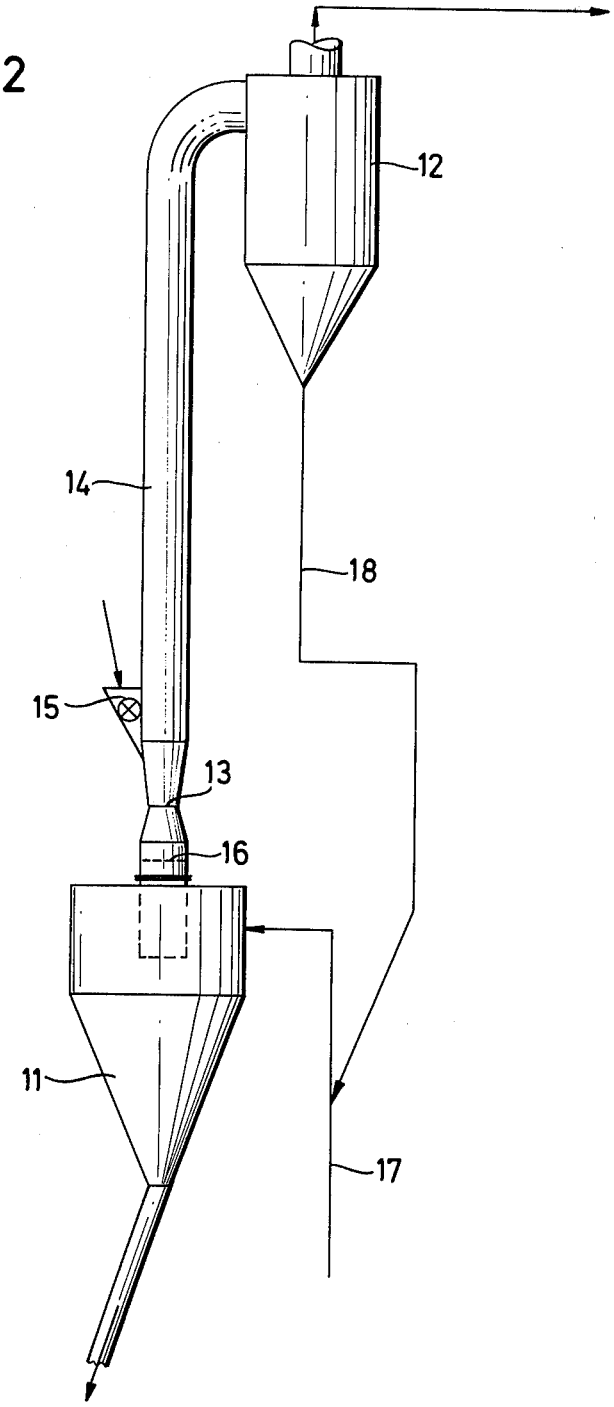
FIG. 2 represents an improvement of the type of system shown in FIG. 1, employing a flow rectifier means in conjunction with the venturi-type constriction.

In the two-step heat exchanger shown in FIG. 2, there are illustrated a lower cyclone separator 11 and an upper cyclone separator 12. A venturi-type cross-sectional constriction 13 is arranged in an exhaust gas conduit 14 extending between a charging point 15 for raw material and the lower cyclone separator 11. The latter may be connected either to a furnace not shown in greater detail in FIG. 2, or with another cyclone separator. Spaced below the venturi-type cross-sectional constriction 13 there is a gas flow rectifier 16. This rectifier 16 may consist of a distributor cross member, grid or sieve.

The provision of the venturi-type cross-sectional constriction 13 above the cyclone separator 11 but below the charging point 15 for raw material provides an increased velocity of gas flow which is high enough so that moist, lumpy portions in the charging material are taken along in suspension by the hot gases passing upwardly through the conduit 14 and are thereby subjected to an intensive drying.

The lower cyclone separator 11 is attached to a hot gas conduit 17 into which a material discharge conduit 18 of the cyclone separator 12 discharges. The hot gases introduced tangentially into the cyclone separator 11 through the hot gas conduit 17 produce a rotational flow therein which may also be continued in the lower area of the exhaust gas conduit 14 extending into the cyclone separator 11. Both these effects can be varied according to need. With the aid of the flow rectifier 16 which is positioned below the venturi-type cross-sectional constriction 13, an equalization of the gas flow can be attained, and a possible dropping of lumpy, moist particles of material downwardly into the cyclone separator 11 is prevented.

The heat exchanger system shown in FIGS. 1 and 2 may, for example, be installed very advantageously for the pretreatment of moist, finely grained materials for the production of cement or for the treatment of friable slags. Since the connecting conduits 3 or 14 are usually very long and therefore act as suspension dryers, in these heat exchange systems very moist materials such as slurries can be handled and subjected to a thermal treatment without the disadvantageous formation of caking or plugging of the material discharge openings on the cyclone separator.

It will be evident that various modifications can be made to the described embodiments without departing from the scope of the present invention.

We claim as our invention:

1. A heat exchanger for the treatment of moist, granular material comprising:

at least two superposed cyclone separators, a relatively long gas conduit connecting the lower cyclone separator to the upper one, at least one burner positioned within said lower cyclone separator, a rotary kiln, conduit means delivering hot gases from said rotary kiln to the lower of said cyclone separators, means for discharging particles from the upper cyclone separator into said conduit means, a burner located in said conduit means, charging means in said relatively long gas conduit for introducing material to be treated near said lower cyclone separator, a venturi-type constriction in said relatively long gas conduit below said charging means, said constriction having its lower end projecting into said lower cyclone separator, and a gas flow rectifier in said relatively long gas conduit below said constriction.

2. A heat exchanger according to claim 1 in which:

said burner in said conduit means is located in close proximity to the point at which said particles from said upper cyclone separator are introduced therein.

3. A heat exchanger according to claim 1 in which:

said relatively long gas conduit is sufficiently long so that substantial drying of the material occurs in transport between said lower cyclone separator to said upper cyclone separator.

* * * * *